US011052625B2

(12) United States Patent
Solano et al.

(10) Patent No.: US 11,052,625 B2
(45) Date of Patent: Jul. 6, 2021

(54) HYDRAULIC PRESS FOR FOOD ITEMS

(71) Applicant: Fresh Press LLC, San Francisco, CA (US)

(72) Inventors: Diego Solano, San Francisco, CA (US); David Lee, San Francisco, CA (US); Mason Curry, Alameda, CA (US); Michael Roberts, San Francisco, CA (US); Timothy Barry, San Francisco, CA (US); Giovanni Scalzo, San Francisco, CA (US); Benjamin McLaughlin, San Francisco, CA (US); Jacob Sandoval, San Jose, CA (US)

(73) Assignee: FRESH PRESS LLC, San Francisco, CA (US)

( * ) Notice: Subject to any disclaimer, the term of this patent is extended or adjusted under 35 U.S.C. 154(b) by 0 days.

(21) Appl. No.: 16/669,207

(22) Filed: Oct. 30, 2019

(65) Prior Publication Data

US 2021/0129473 A1 May 6, 2021

(51) Int. Cl.

| | |
|---|---|
| ***B30B 9/06*** | (2006.01) |
| ***B65D 75/58*** | (2006.01) |
| ***B65D 85/72*** | (2006.01) |
| ***B30B 9/26*** | (2006.01) |

(52) U.S. Cl.

CPC ..... *B30B 9/06* (2013.01); *B30B 9/26* (2013.01); *B65D 75/5861* (2013.01); *B65D 85/72* (2013.01)

(58) Field of Classification Search

CPC ..... B30B 9/06; B30B 9/26; B65D 75/5861; B65D 85/72

USPC ..... 222/103, 92

See application file for complete search history.

(56) References Cited

U.S. PATENT DOCUMENTS

| | | | | | |
|---|---|---|---|---|---|
| 818,796 | A * | 4/1906 | Spengler | B30B 9/06 | 100/317 |
| 2,022,679 | A * | 12/1935 | Leo | B30B 9/10 | 100/194 |
| 2,551,886 | A * | 5/1951 | Jones | B30B 9/06 | 100/125 |
| 3,159,096 | A * | 12/1964 | Tocker | B65D 33/30 | 100/211 |
| 4,636,412 | A * | 1/1987 | Field | A61J 1/10 | 604/408 |
| 4,645,094 | A * | 2/1987 | Acklin | A47K 5/1217 | 222/103 |

(Continued)

*Primary Examiner* — Michael J. Melaragno

(74) *Attorney, Agent, or Firm* — David R. Stevens; Stevens Law Group

(57) ABSTRACT

A press includes a movable platen and a non-moving platen within a housing defining a pressing chamber, an opening is defined at the top of the pressing chamber for receiving a juice pack and an outlet is defined in a front wall of the chamber vertically between the top and bottom of the movable platen. The lid may include a front portion extending over the front of the pressing chamber and defining a slot that is aligned with a slot defined by the front wall to form the outlet. The front wall, the lid, and a sidewall may be removable for cleaning. The juice pack may have edges defining a rectangle with a spout at a first corner and an aperture for suspending the juice pack in the pressing chamber at a second corner that is intersected by a same edge intersecting the first corner.

16 Claims, 11 Drawing Sheets

(56) References Cited

U.S. PATENT DOCUMENTS 4,808,346 A * 2/1989 Strenger ..... A47J 31/407 222/129.1
4,898,304 A * 2/1990 Bacon, Jr. ..... B67D 7/0227 100/293
4,899,911 A * 2/1990 Rohde ..... B67D 1/0001 222/103
4,915,261 A * 4/1990 Strenger ..... A47J 31/407 222/107
4,991,743 A * 2/1991 Walker ..... A61M 5/148 222/103
5,100,025 A * 3/1992 McGraw ..... A47K 5/1211 222/103
5,281,202 A * 1/1994 Weber ..... A61M 1/029 222/103
6,200,300 B1 * 3/2001 Petriekis ..... B65D 75/563 206/219
6,626,329 B2 * 9/2003 Rake ..... A61M 5/148 128/DIG. 12
7,086,428 B2 * 8/2006 Schroeder ..... B67D 7/0216 141/65
2004/0069021 A1 * 4/2004 Bringewatt ..... B30B 9/06 68/21
2008/0121662 A1 * 5/2008 Gehl ..... B67D 1/1231 222/214
2011/0120323 A1 * 5/2011 Comandini ..... B30B 9/06 100/131
2012/0104020 A1 * 5/2012 Cur ..... F25D 23/126 222/1
2015/0048112 A1 * 2/2015 Skillin ..... B65D 75/5883 222/107
2015/0158714 A1 * 6/2015 Boyer ..... B67D 7/0216 222/103
2015/0274375 A1 * 10/2015 Kling ..... A47K 5/1211 222/103
2015/0359256 A1 * 12/2015 Wettlaufer ..... B30B 9/045 100/37
2015/0374025 A1 * 12/2015 Evans ..... B30B 9/20 99/495
2017/0252990 A1 * 9/2017 Schultz ..... A47J 31/407
2017/0252991 A1 * 9/2017 Wood ..... B30B 9/042
2017/0252992 A1 * 9/2017 Wood ..... A47J 31/407
2017/0252993 A1 * 9/2017 Katz ..... B65D 85/72
2017/0252994 A1 * 9/2017 Schultz ..... B30B 9/06
2017/0252995 A1 * 9/2017 Schultz ..... B30B 9/06
2017/0252996 A1 * 9/2017 Schultz ..... A47J 19/02
2017/0252997 A1 * 9/2017 Schultz ..... A23L 2/04
2017/0252998 A1 * 9/2017 Katz ..... B30B 9/04
2017/0252999 A1 * 9/2017 Schultz ..... B65D 85/72
2017/0253000 A1 * 9/2017 Wood ..... B65D 75/5866
2017/0253402 A1 * 9/2017 Melville, Jr. ..... B65D 75/322
2017/0253403 A1 * 9/2017 Evans ..... B29C 65/02
2017/0253404 A1 * 9/2017 Katz ..... B65D 85/72
2017/0313012 A1 * 11/2017 Katz ..... B30B 9/262
2018/0242770 A1 * 8/2018 Sheba ..... A23L 2/04
2018/0297309 A1 * 10/2018 Evans ..... B65D 83/00
2018/0297310 A1 * 10/2018 Evans ..... B65D 81/3261
2018/0297311 A1 * 10/2018 Katz ..... B30B 1/006
2018/0297312 A1 * 10/2018 Katz ..... B30B 9/04
2018/0297313 A1 * 10/2018 Katz ..... B30B 9/04
2019/0184666 A1 * 6/2019 McGrane ..... B30B 9/06
2019/0261804 A1 * 8/2019 Balcacer ..... A47J 19/023

* cited by examiner

HYDRAULIC PRESS FOR FOOD ITEMS

RELATED APPLICATIONS

This application is related to U.S. application Ser. No. 16/669,242 filed Oct. 30, 2019 and U.S. application Ser. No. 16/713,402 filed Dec. 13, 2019, which are hereby incorporated herein by reference in their entirety for all purposes.

BACKGROUND

Devices for extracting fresh juice from food matter such as fruits and vegetables have been developed over the years for both home and commercial markets. In commercial applications, a press needs to be robust and cleanable. A press may also need to be able to have a high capacity in order to meet demand of a cafeteria, restaurant, or juice bar.

It would be an advancement in the art to provide an improved press for use in commercial applications.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1A:
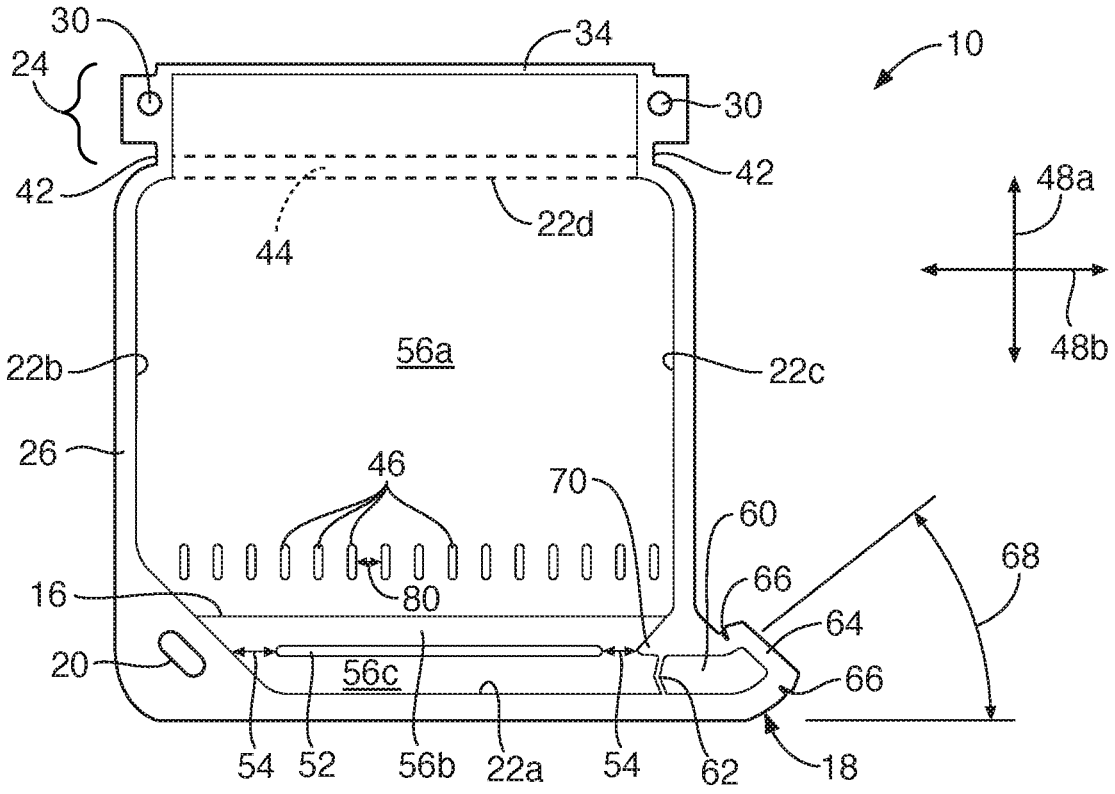
FIG. 1A is front view of a juice pack in accordance with an embodiment of the present invention.
Figure 1B:
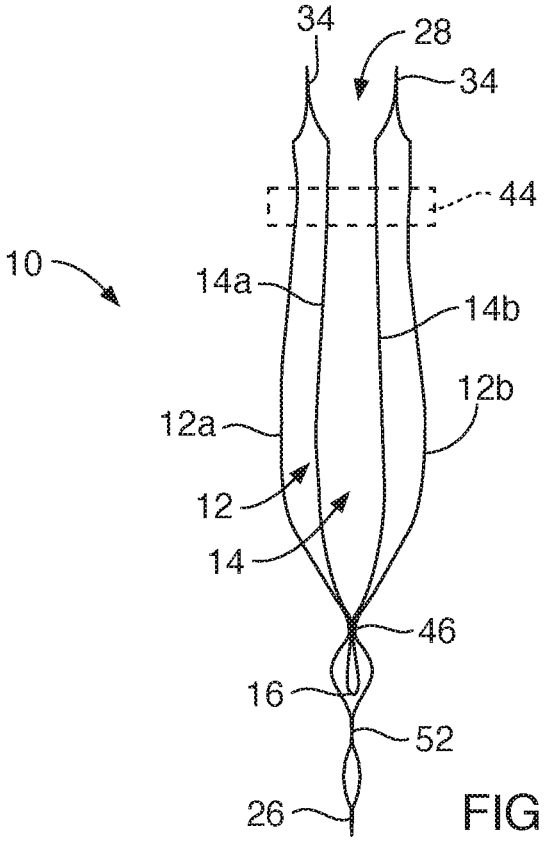
FIG. 1B is a side view of the juice pack of FIG. 1A.

Referring to FIGS. 1A and 1B, the press as described below may be used using the illustrated juice pack 10. The juice pack 10 may be formed of a front layer 12*a* and a back layer 12*b* defining a compartment 12 between them. In some embodiments, the front layer and back layer 12*a*, 12*b* are separate layers fused together. In others, the front layer and back layer 12*a*,12*b* are formed monolithically, such as by co-molding to form the compartment 12.

In some embodiments, a filter pouch 14 is positioned within the compartment 12. For example, a sheet of filter material may be positioned in the compartment 12 with one side 14*a* interfacing with the front layer 12*a* and one side 14*b* interfacing with the back layer 12*b* with a fold 16 in the layer 12*a* between the sides 14*a*, 14*b*. Note that sides 14*a*, 14*b* may be formed of separate pieces such that the sides 14*a*, 14*b* are fused to one another at their bottom edges in place of the fold 16.

The juice pack 10 may further define a spout 18 that is in fluid communication with the compartment 12 such that contents of the filter pouch 14 forced through the filter pouch 14 may exit the compartment 12 through the spout 18.

The juice pack 10 may further define a hanger 20 for suspending the juice pack 10 within a press, such as a press as described herein below. For example, the hanger 20 may be an opening passing through portions of the front and back layers 12*a*, 12*b* defining a perimeter of the compartment 12.

In the illustrated embodiment, the front and back layers 12*a*, 12*b* have edges 22*a*, 22*b*, 22*c* and 22*d* defining a quadrilateral shape, such as a rectangle or square. As is apparent in FIG. 8, there may be curved, angled, or other-shaped transitions between edges 22*a*-22*d*. In the illustrated embodiment, the spout protrudes from a region intersected by bottom edge 22*a* and a right edge 22*c* (not that bottom, top, left, and right are relative to the figure and do not indicate actual orientation during use). In the illustrated embodiment, the hanger 20 is formed in a region intersected by the same bottom edge 22*a* and a left edge 22*b*. As shown in the figures below, using this orientation the spout 18 is elevated when the juice pack is suspended by the hanger 20.

In some embodiments, prior to filling and sealing, there are extensions 24 of the front and back layers 12*a*, 12*b*, and possibly the sides 14*a*, 14*b* of the filter pouch. Prior to filing, the front and back layers 12*a*, 12*b* are fused along the bottom, left, and right edges 22*a*-22*c* and the top edge 22*d* is not fused such that the extensions 24 defines an opening for placing of food items within the compartment 12. In the illustrated embodiment, the front and back layers 12*a*, 12*b* are separate layers of impermeable material fused to one another along their perimeters in region 26 in order to define the compartment 12. Note also that the edges of sides 14*a*, 14*b* of the filter pouch 14 may also extend into this region 26 and may likewise be fused in order to form the filter pouch 14. As shown in FIG. 1B, prior to filling, the compartment 12 and filter pouch 14 are open at the top of the extension 24 to define an opening 28 for inserting food items. The hanger 10 may be formed in a widened portion of the fused region 26 that is located at the intersection of the right edge 22*b* and the bottom edge 22*a*

In some embodiments, the extension 24 includes holes 30 for suspending the juice pack 10 during filling. For example, there may be tabs 32 that are part of the fused region 26 that protrude outwardly. In use, these holes 30 may be suspended on hooks, posts, or some other structure to support the juice pack 10.

In some embodiments, upper edges of the sides 14*a*, 14*b* of the filter pouch 14 may be fused in regions 34 to the extensions 24 of the front and back layers 12*a*, 12*b*, respectively such that edges of the sides 14*a*, 14*b* of the filter pouch 14 do not interfere with filling of the compartment 12 and filter pouch.

In the illustrated embodiment, the extension 24 is narrower than the compartment 12. For example, a separation between sides 42 of the extension along a dimension parallel to the bottom 22*a* may be smaller than a separation between the left edge 22*b* and right edge 22*c* along the same dimension.

Following filling, a region 44 extending between portions of the fused region 26 on either side of the compartment 12 may be fused to define the upper edge 22*d* of the compartment 12. The extension 24 above this fused region 34 may then be trimmed off. As is apparent, fusing region 44 will fuse all of the front and back layers 12*a*, 12*b* and the sides 14*a*, 14*b* of the filter pouch, thereby also closing the filter pouch and the chamber 12 at the top.

In some embodiments, there may be additional fused regions (fusing of the layers 12*a*, 12*b* and sides 14*a*, 14*b*) to improve functioning of the juice pack 10. For example, in some applications, the pressure applied to the juice pack may be very high. As discussed below, a burstable seal may be used such that this pressure may be released suddenly. To avoid bursting of the filter pouch, a row of fused regions 46 may be defined along the bottom edge 22*a*, e.g. offset from the bottom edge 22*a* such that they are closer to the bottom edge 22*a* than to the top edge 22*b* but such that the fold 16 of the filter pouch 14 is located between the fused regions 46 and the bottom edge 22*a*. For example, the top of the fused regions in FIG. 1A may be less than 10 percent of the separation between edges 22*a*, 22*b* from the edge 22*a* along a vertical direction 148*a*.

As is apparent, the fused regions 46 may be distributed in row. For example, the vertical dimension 48*a* may be defined as substantially parallel to the left and right edges 22*a*, 22*b* of the compartment 12. For purposes of this disclosure the term "substantially" used with reference to an angle shall be understood to mean within 5 degrees of that angle. A horizontal dimension 48*b* may be defined that is perpendicular to the vertical dimension 48*a* and substantially parallel to the bottom and top edges 22*a*, 22*d*.

In the illustrated embodiment, the fused regions 46 are distributed along a line parallel to the horizontal dimension 48*b* and are separated by gaps 50 along the horizontal dimension 48*a*. As is apparent, the fused regions 46 have a length in the vertical direction 48*b* that is greater (between 2 and 5 times) than the width of the regions 46 in the horizontal direction 48*a*. Note also that the gap 50 between adjacent fused regions 46 may have a width in the horizontal direction 48 that is greater (between 2 and 4 times) than the width of the individual regions 46.

The fused regions 46 may reduce stress on the fold 16 of the filter pouch 14. For example, the fused regions 46 may limit the flow of material toward the fold 16 upon bursting of the burstable seal and may reduce the amount of bulging outwardly of the filter pouch 14 in the region of the fold 16.

In some embodiments, an additional fused region 52 (fusing of the front and back layers 12*a*, 12*b*) may be defined in the compartment 12 below the fold 16 of the filter pouch 14, such as between the fold 16 and the lower edge 22*a*. In the illustrated embodiment, the fused region 52 is an elongate fused region with the long dimension thereof substantially parallel to the bottom edge 22*a* and the horizontal direction 48*b*.

Fluid flow around the fused region 52 to the spout 18 may be facilitated by gaps 54 between the ends of the fused region 52 and the perimeter of the chamber 12, i.e. the fused region 26. As shown, the length of the fused region 52 in the horizontal dimension 48*b* is much larger (between 5 and 10 times) than the combined width of the gaps 54 in the horizontal dimension 48*b*.

As is apparent, the fused regions 46 and the elongate fused region 52 divide the compartment 12 into three regions 56*a*, 56*b*, and 56*c*. In operation, food items are located within region 56*a*. Upon pressing, juice and other material may be forced past the fused regions 46 and out of the filter pouch 14. This juice may then be force around the elongate fused region 52 into the region 54*c*. As is apparent, the region 54*c* is connected to the spout 18.

The fused region 26 may define a channel 60 connected to region 56*c* that is blocked by a burstable seal 62. For example, the burstable seal 62 may be a fused region of the front and back layers 12*a*, 12*b* that is weakly fused as compared to the fused region 26 and therefore burstable at pressures lower than that required to burst the fused region 26. In the illustrated embodiment, the seal 62 is a sideways "v" with the point of the v pointing toward the region 56*c*. In this manner, the point of the V will tend to be pried apart by pressure in order to burst the seal 62. An example approach for implementing a burstable seal is described in U.S. application Ser. No. 15/447,358 filed Mar. 2, 2017, and entitled JUICER CARTRIDGE WITH BURSTABLE SEAL, which is hereby incorporated herein by reference in its entirety.

Upon bursting of the seal 62, fluid in the region 54*c* is allowed to flow out of the channel 60 and exit the chamber 12. Presence of the elongated fused region 52 limits the rate of flow from regions 56*a* and 56*b* into the region 56*c* and therefore moderates the outflow of liquid, thereby reducing instances of splattering or rupturing of the spout 16 or portion of the region 26 defining the bottom edge 22A. Note that the elongated fused region 52 may be omitted in some applications and is not required for normal function of the juice pack 10.

In some embodiments, the spout 16 may include a removable closure 64, which may be embodied as a portion of the fused region 26 having notches 66 on either side of the channel 60 that facilitate manual tearing off of the closure 64.

FIG. 1A further illustrates other features of the spout 18. In particular, note that the channel 16 may be curved or bent such that the edges at the end of the channel 60 (furthest from the chamber 12) are not parallel to the lower edge 22*a* but rather is bent away from the bottom edge 22*a*. In particular, the angle 66 of the end portions of the channel 60 may be substantially 45 degrees relative to edge 22*a* such that the end portion points substantially vertically downward when the juice pack 10 is suspended by the hanger 10.

In the illustrated embodiment, a protuberance 70 extends inwardly from the edge 22*c* along the channel 62 and the burstable seal extends between this protuberance 70 and the bottom edge 22*a*. The protuberance 70 may be embodied as a fused portion of the layers 12*a*, 12*b*. As is apparent, an inner portion of the channel 60 may therefore be defined by an edge of the protuberance 70 and the bottom edge 22*a*. In the illustrated embodiment, the height of the channel in the vertical direction is the same as a height of the portion 56*c* between the bottom edge and the elongated member 52.

Figure 2A:
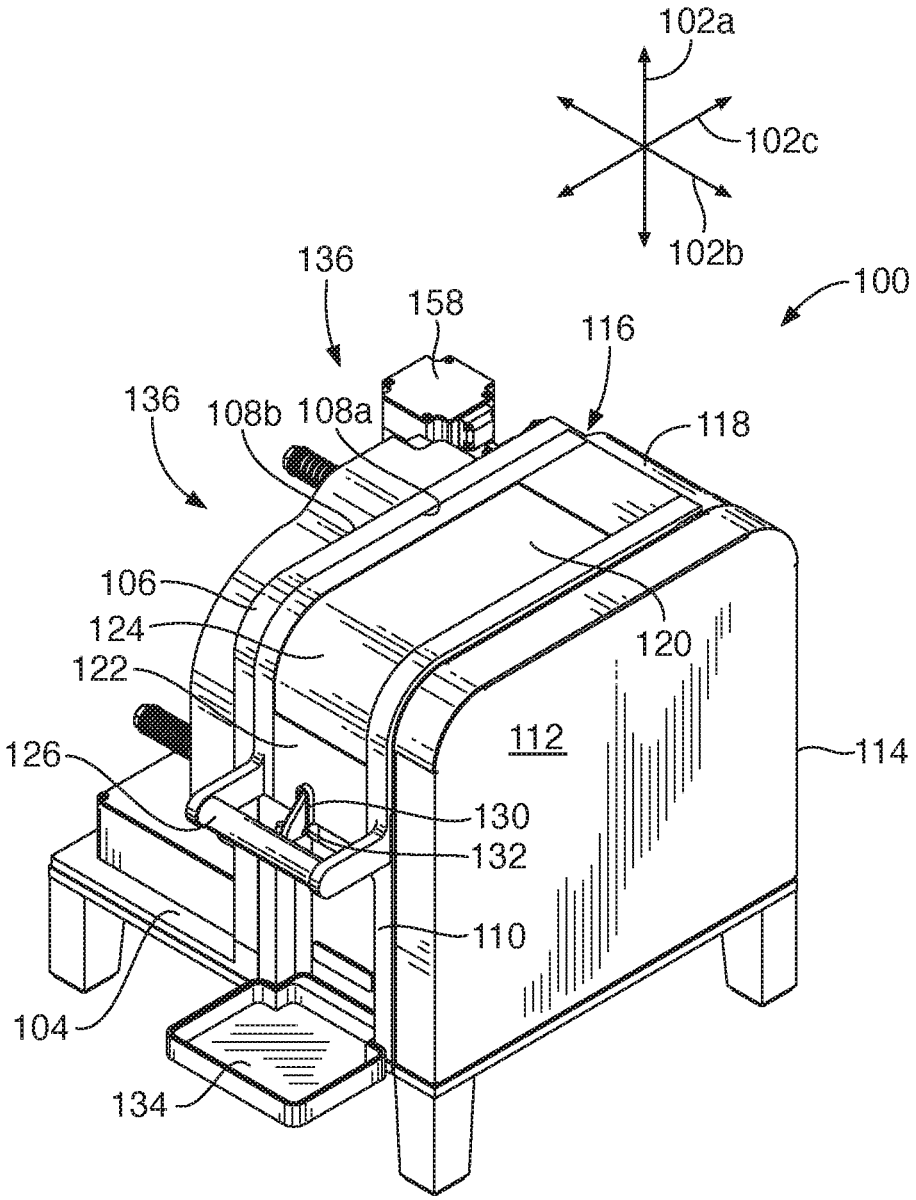
FIGS. 2A to 2C are isometric views of a press in accordance with an embodiment of the present invention.
Figure 2B:
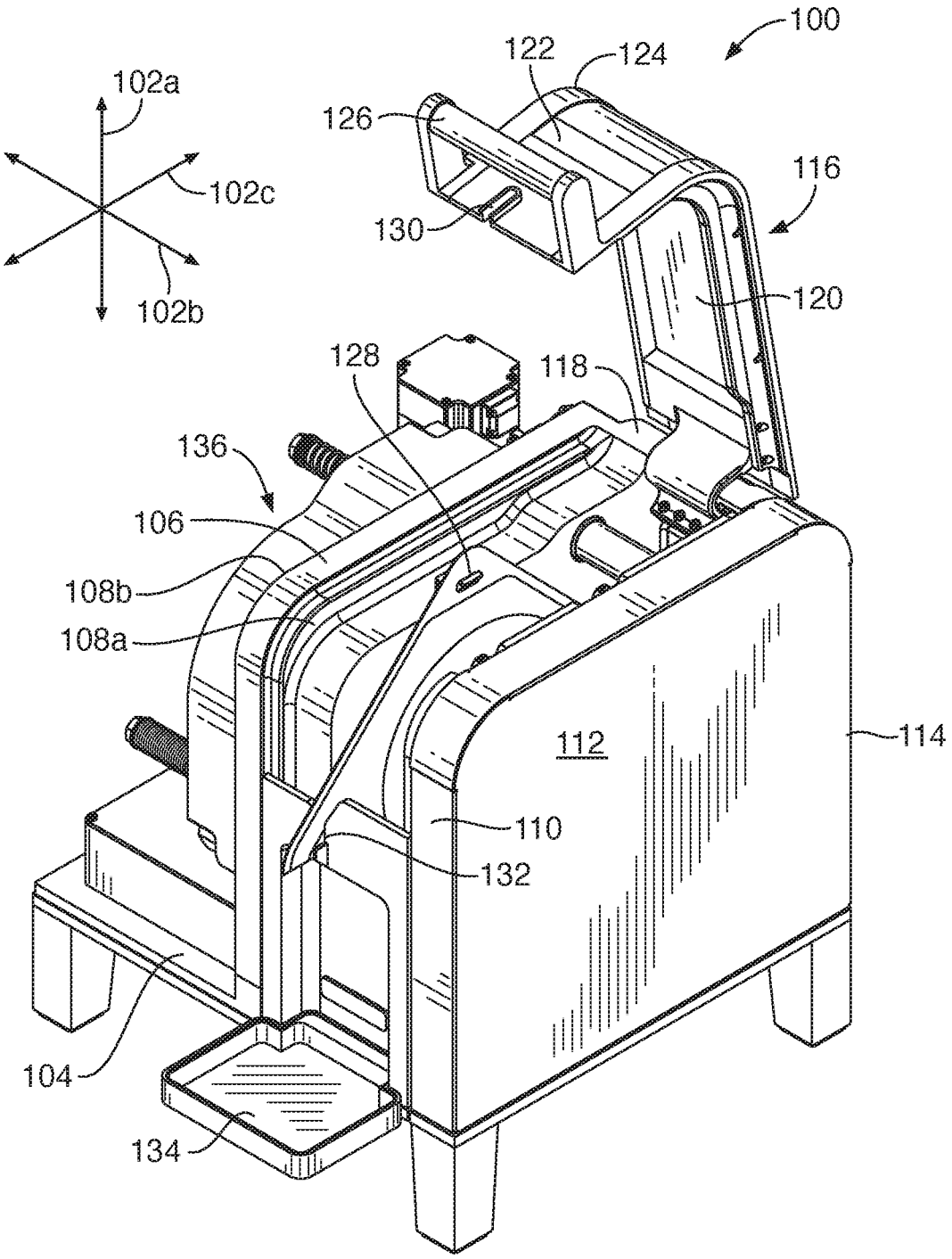
Figure 2C:
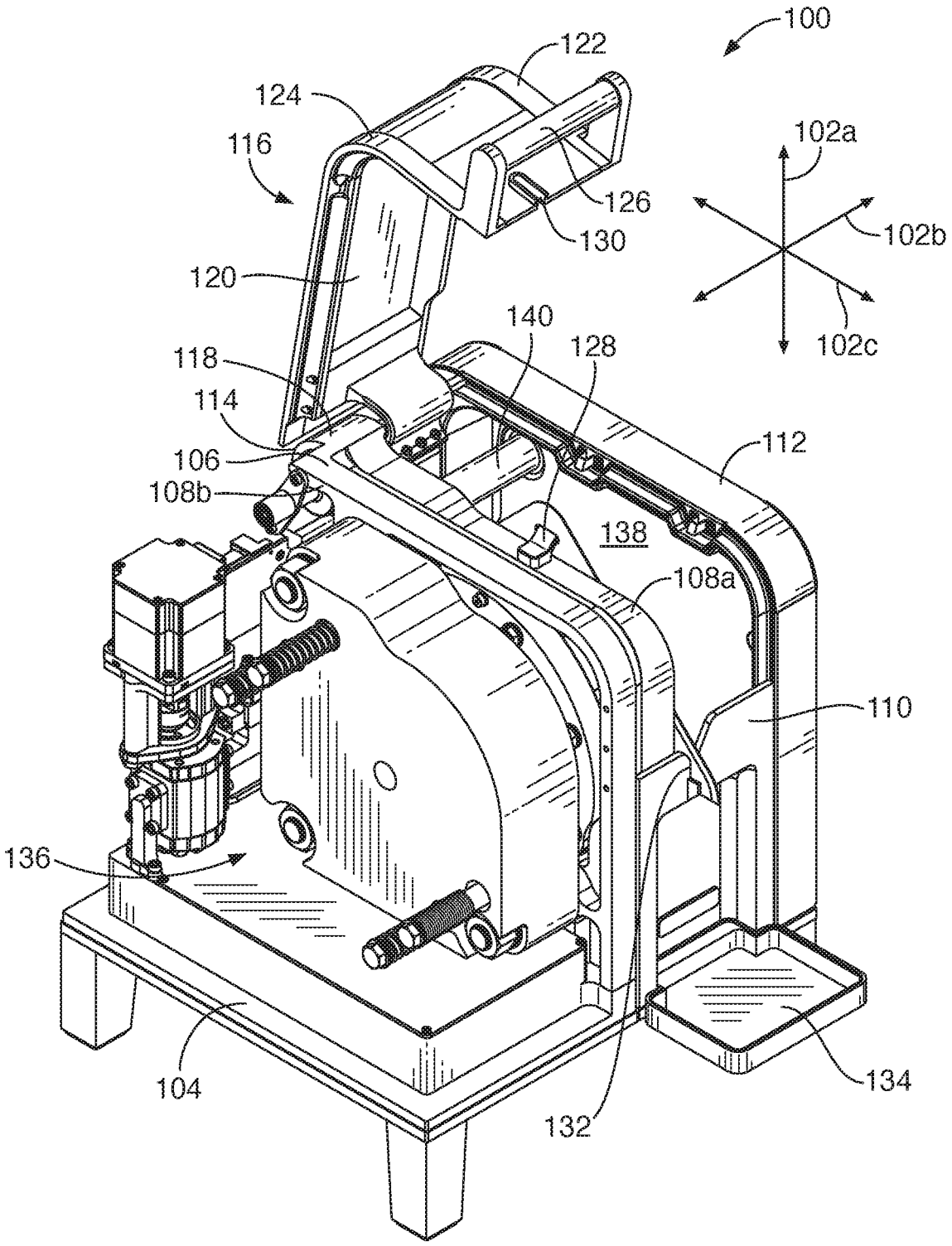

Referring to FIGS. 2A, 2B, and 2C, the illustrated press 100 may be used to press food items contained within a juice pack, such as the juice pack 10 described above with respect to FIGS. 1A and 1B. The operation and structure of the press 100 may be understood with respect to a vertical direction 102*a*, horizontal direction 102*b*, and a longitudinal direction 102*c* that are all perpendicular to one another with the vertical direction 102*a* being substantially parallel to the direction of gravity during use.

The press 100 may include a base 104 for supporting the press 100 on a supporting surface and being substantially parallel to the horizontal direction 102*b* and the longitudinal direction 102*c*. In the illustrated embodiment, the base 104 is supported by feet located at its corners, but these may be omitted or substituted in other embodiments.

A wall 106 extends vertically upward from the base 104 and has a pressing side 108*a* and a drive side 108*b* that are oriented substantially parallel to the vertical and longitudinal directions 102*a*, 102*c*. As described in greater detail below, the pressing side may function as a non-moving platen for pressing the juice pack 10. As also described in greater detail below, the drive side 108*b* may form part of a hydraulic drive system for actuating a movable platen.

The pressing side 108*a* may cooperate with a front wall 110, sidewall 112, rear wall 114, and the base 104 to define a pressing chamber. The front wall 110 and rear wall 114 may be substantially parallel to the vertical and horizontal directions 102*a*, 102*b*, the sidewall 112 may be substantially parallel to the vertical and longitudinal directions 102*a*, 102*c*.

A lid 116 covers the pressing chamber during use and may be attached by a hinge to the rear wall 114. In particular, the rear wall 114 may include a curved top portion 118 that curves inwardly toward the lid 116 and the lid 116 may attach to this curved top portion 118 by means of a hinge. As is apparent, the lid 116 includes a top portion 120 that is parallel to the horizontal and longitudinal directions 102*b*, 102*c* during use and a front portion 122 that is parallel to the vertical and horizontal directions 102*a*, 102*b*. The lid 116 may include a curved transition 124 between the top portion 120 and front portion 122 that may have a radius of curvature matching that of the curved top portion 118. The curved top portion 118 and curved transition 124 may be curved about an axis substantially parallel to the horizontal direction 102*b*. A handle 126 may be secured to the lid, such as to the front portion 122 to facilitate opening.

In operation, the juice pack 100 is placed in the pressing chamber with the hanger 20 engaging either the wall 106 or side wall 112 and the lid 116 is closed. For example, in the illustrated embodiment, a hook 128 is secured to the wall 106 and the hanger 20 is placed over the hook 128. In this orientation, the vertical dimension 48*a* of the juice pack 10 is oriented at substantially 45 degrees relative to the vertical direction 102*a* and the spout 18 of the juice pack 10 protrudes outwardly with the opening of the spout protruding outwardly from the front wall 110 and from the front portion 122 of the lid 116 when the lid 116 is closed.

The lid 116 and front wall 110 may define an opening through which the spout may protrude. In the illustrated embodiment, this includes a slot 130 extending upwardly from a lower edge of the front portion 122 of the lid 116 and a slot 132 extending downwardly from an upper edge of the front wall 110 such that sides of the slots 130, 132 are substantially (e.g., within 3 mm) aligned when the lid 116 is closed. The width of the slots 130, 132 in the horizontal direction 102*b* may be such that the spout 18 may pass therethrough without interference and may be sufficient to receive the spouts 18 of multiple juice packs 10 simultaneously (e.g. from 2 to 10) such that juice may be extracted from multiple juice packs 10 at the same time, provided they and their contents fit within the pressing chamber. For example, the slots 130, 132 may have widths of between 4 and 15 mm. The combined heights (distance from bottom of slot 132 to the top of slot 130 when the lid 116 is closed) of the slots 130, 132 may be equal to a tolerance plus the extent of the spout 18 in the vertical direction 102*a* when in the illustrated orientation with its vertical dimension 48*a* oriented 45 degrees relative to the vertical direction 102*a*. For example, the tolerance may be between 2 and 10 mm. The heights of the slots 130, 132 may be equal or unequal. In some embodiments, only one slot is used. For example, a slot 132 may be used whereas slot 130 is omitted. In such embodiments, the slot 132 may have a height equal to the combined height of the slots 130, 132 as defined above. In the illustrated embodiment, the front portion 122 of the lid 116 overlaps the front wall 110 along the vertical direction 102*a* such that the slots 130, 132 likewise overlap one another.

As is also apparent, the spout 18 protrudes from the pressing chamber at a position along the vertical direction 102*a* that is substantially centered between the top and bottom of the movable platen 138, e.g., the bottom of the slot 132 and the top of the slot 130 when the lid is closed may be vertically located within a region that is within 20 percent, preferably within 10 percent of the vertical height of the movable platen 138 from the vertical center of the movable platen.

A cup holder 134 may secure to the front wall 110 in order to support a cup receiving juice emitted from the spout 118. Alternatively, a cup or pitcher may be placed on the same support surface on which the press 100 rests in order to receive the juice. For example, the cup holder 134 may be removable.

As shown in FIG. 2C a drive 136, such as a hydraulic drive 136, is positioned on the drive side 108*b* of the wall 106. The drive 136 engages a movable platen 138 that is positioned within or near the side wall 112 during loading. The drive 136 may engage the movable platen 138 by means of one or more shafts 140 passing through the wall 106 and engaging both the drive 136 and the movable platen 138. The drive 136 may draw the shafts 140 toward itself in order to move the movable platen 138 toward the wall 106, thereby pressing a juice pack 10 positioned between the wall 106 and movable platen 138.

Figure 3A:
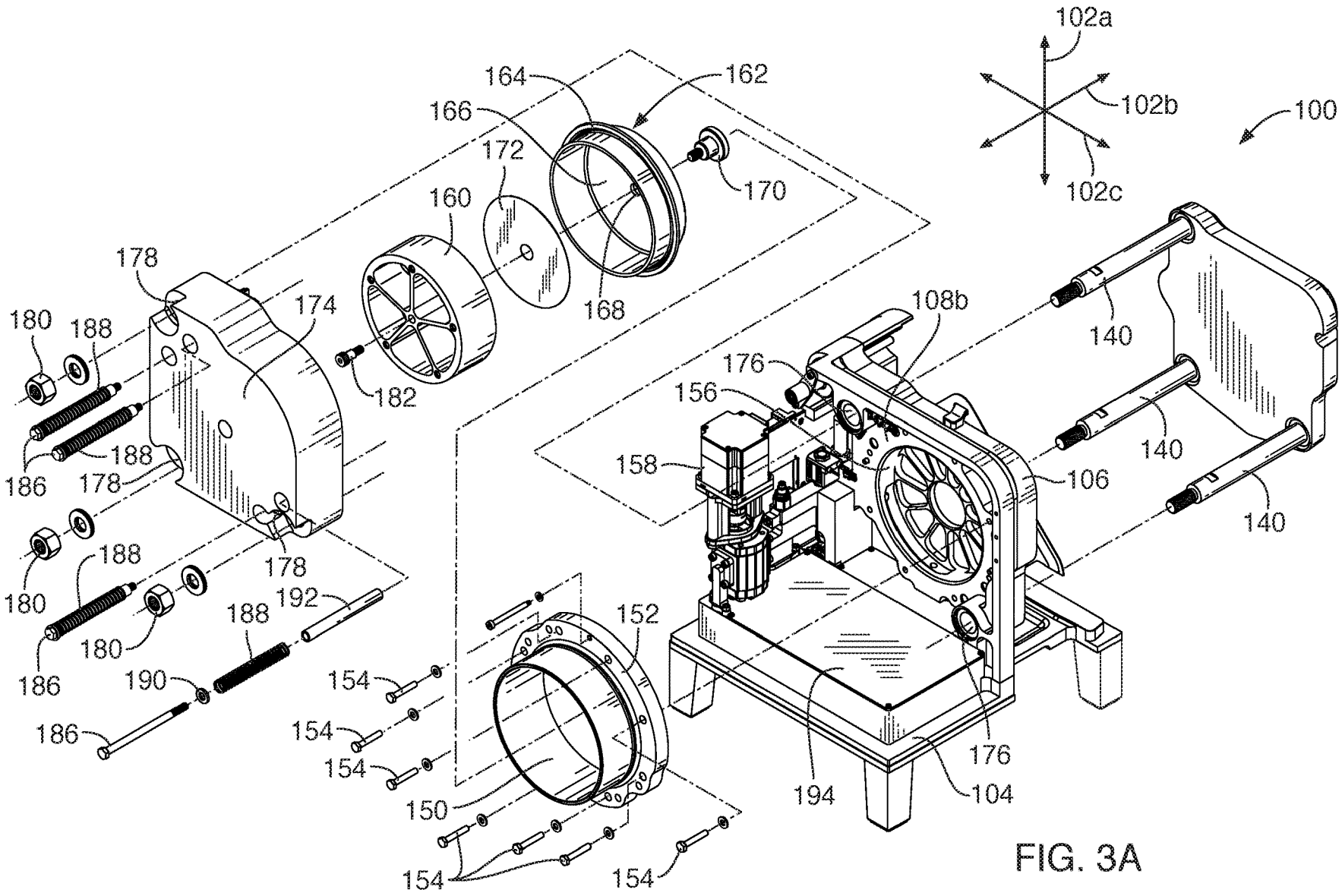
FIG. 3A is an exploded view of a hydraulic drive of a press in accordance with an embodiment of the present invention.
Figure 3B:
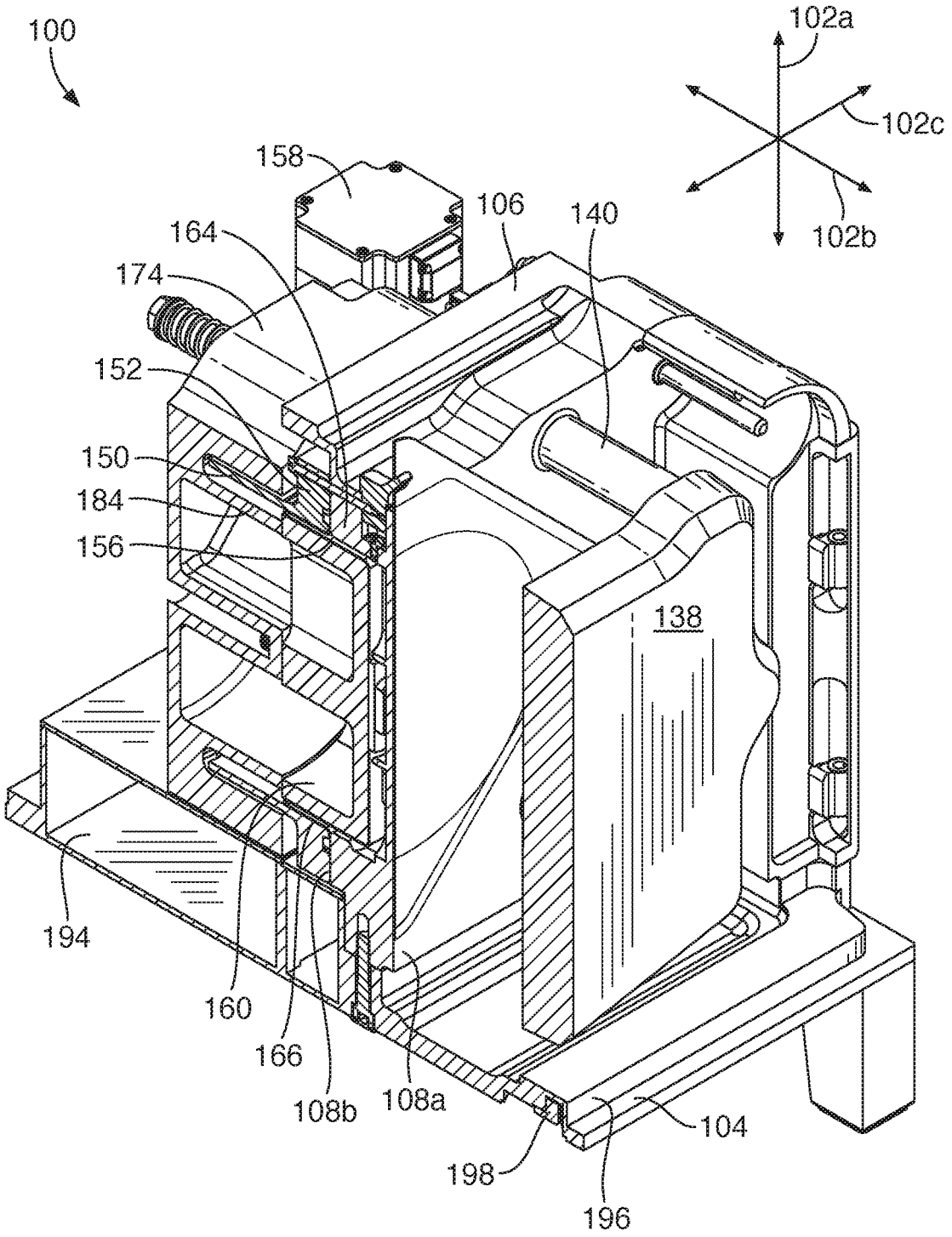
FIG. 3B is a cross-sectional view of the hydraulic drive of a press in accordance with an embodiment of the present invention.

Referring to FIGS. 3A and 3B, the drive 136 may include a cylinder 150 mounted to the wall 106 and protruding outwardly from the drive side 108*b* of the wall 106. The axis of symmetry of the bore of the cylinder 150 may be substantially parallel to the horizontal direction 102*b*. In the illustrated embodiment, the cylinder 150 includes a rim 152 that is secured to the wall 106 by fasteners 154.

In some embodiments, a chamber 156 is formed in the wall 106 that extends partially through the wall 106 from the drive side 108*b*. The chamber 156 may be cylindrical with an inner diameter and position matching (e.g., within 3 mm) the inner diameter and position of the cylinder 150 when secured to the wall 106. The axis of symmetry of the chamber 156 may be substantially parallel to that of the cylinder 150. The chamber 156 may be coupled to a hydraulic pump 158 such that hydraulic fluid may be pumped into and out of the chamber 156.

A piston 160 is slidably positioned within the cylinder 150 and may also move into the chamber 156 during operation. The piston 160 may be cylindrical with its axis of rotational substantially parallel to the axis of symmetry of the cylinder 150. The diameter of the piston 160 is smaller than the inner diameter of the cylinder 150 and chamber 156 and may provide clearance for a folding diaphragm 162. In particular, the diaphragm 162 may be hat-shaped with the brim 164 of the hat captured between the cylinder 160 and the wall 106 (see cross-sectional view of FIG. 3B). The crown 166 of the hat extends from the brim of the hat away from the wall 106. Accordingly, when the piston is at its right-most position in the orientation of FIGS. 3A and 3B, the crown 166 will be collapsed and folded over itself as shown in FIGS. 3A and 3B. When the piston 160 is at its left-most position (forced away from the wall 106 by hydraulic pressure), the crown 166 will unfold partially or completely from its collapsed position.

In the illustrated embodiment, an opening 168 in the crown 166 of the hat-shaped diaphragm 162 receives a fastener 170 that secures the crown 166 to the piston 160 thereby maintaining the position of the diaphragm and hindering misalignment during use. In the illustrated embodiment, a spacer 172 is positioned between the diaphragm and the piston 160. The piston 160 may be hollow to reduce its weight such that the spacer 172 is a round metal plate that extends across the open regions of the piston 160 in order to distribute hydraulic pressure to the outer diameter of the piston 160 and any reinforcing webs within the piston 160.

The piston 160 may be secured to a distributor plate 174 that extends outwardly from the piston 160 in a plane parallel to the vertical and longitudinal directions 102*a*, 102*c*. The shafts 140 secured to the movable platen 138 may secure to the distributor plate 174. For example, the shafts 140 may slidably pass through openings 176 in the wall 106 and through openings 178 in the distributor plate 174. The shafts 140 may resist removal by means of nuts 180 engaging threaded end portions of the shafts 140. In particular, force exerted on the piston 160 by hydraulic fluid within the cylinder 150 and chamber 156 is transferred to the distributor plate 174. The distributor plate 174 pushes against the nuts 180, thereby pulling the shafts 140 to the left and drawing the movable platen 138 toward the pressing side 108*a* of the wall 106.

In order to isolate the pressing chamber from the drive 136, one or more O-rings may be positioned within each opening 178, such as within circumferential groves formed therein, with the shafts 140 passing through the O-rings and elastically deforming them in order to provide a sliding seal.

In the illustrated embodiment, there are three shafts 140. In the illustrated distribution, no shaft 140 is positioned adjacent at the top of the front wall 110 and therefore no shaft 140 interferes with positioning of the spout 18 of a juice pack 10 in the manner described above with respect to FIGS. 2A to 2C. The three shafts 140 may be distributed in the vertical-longitudinal plane (parallel to directions 102*a*, 102*c*) in corners of the wall 106 such that when the juice pack 10 is oriented diagonally as described above the shafts 140 will not interfere with the juice pack 10 since the corners of the juice pack 10 are positioned between adjacent shafts 140.

In some embodiments, the distributor plate 174 is secured to piston 160 by means of a fastener 182 to ensure that the distributor plate 174 slides to left and right in tandem with the piston 160. In some embodiments, the distributor plate 174 defines a cylindrical groove 184 (see FIG. 3B). When the movable platen is moved to the right, the groove 184 provides clearance for the cylinder 150 that inserts within the groove 184. Accordingly, the axis of symmetry of the groove 184 may be substantially parallel to that of the cylinder 150.

In some embodiments, a biasing system provides a restoring force that urges the distributor plate 174 and piston 160 toward the wall 106 when hydraulic pressure is not applied to the piston 160. For example, a plurality of bolts 186 may pass through the distributor plate 174 and secure to the wall 106. Springs 188 encircle the bolts 186 and are positioned between the distributor plate 174 and the heads of the bolts 186. In this manner, the springs 188 tend to urge the distributor plate toward the wall 106. In some embodiments, washers 190 distribute force from the springs 188 to the heads of the bolts. In some embodiments, cylindrical sheaths 192 are positioned around the shafts of the bolts 186 and are positioned between the bolts 186 and the springs 188 in order to provide a smooth surface engaging the springs 188.

In the illustrated embodiment, there are four bolts 186 and corresponding springs 188. The bolts 186 may be positioned in pairs with each pair being positioned around one of the shafts 140 and corresponding openings 178.

In some embodiments, a reservoir 194 for hydraulic fluid is positioned on the base 104 on the drive side 108*b* of the wall 106 and is coupled by hydraulic lines to the hydraulic pump 158. The height of the reservoir 194 may be such that it does not interfere with movement of the piston 160 and distributor plate 174.

As shown in FIG. 4B, a portion of the base 104 adjacent the right side may be raised thereby defining a shoulder or stop surface 196 that is parallel to the vertical and longitudinal directions 102*a*, 102*c* and extends along the right edge of the base 104 set inwardly from the right edge. In some embodiments, a magnet 198 may be embedded in the base adjacent this stop surface 196 in order to detain a cover positioned on the right side of the press 100 as described below.

Figure 4:
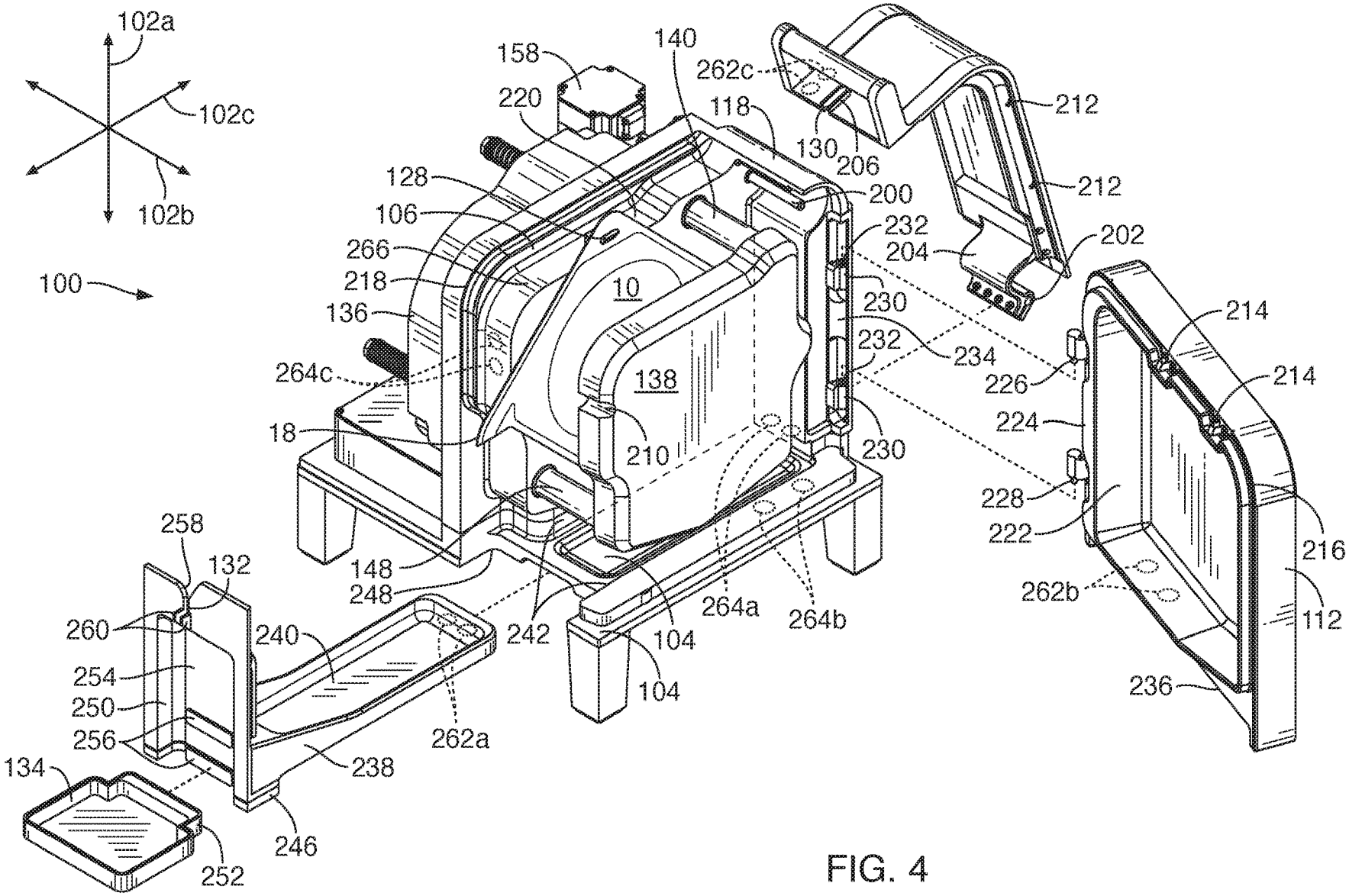
FIG. 4 is an exploded view of a housing of a press in accordance with an embodiment of the present invention.

Referring to FIG. 4, in some embodiments the housing of the press 100, particularly those components surrounding the pressing chamber on the pressing side 108*a* of the wall 106, may be removable in order to facilitate cleaning. In particular, these components may be removable without the use of tools.

Figure 5:
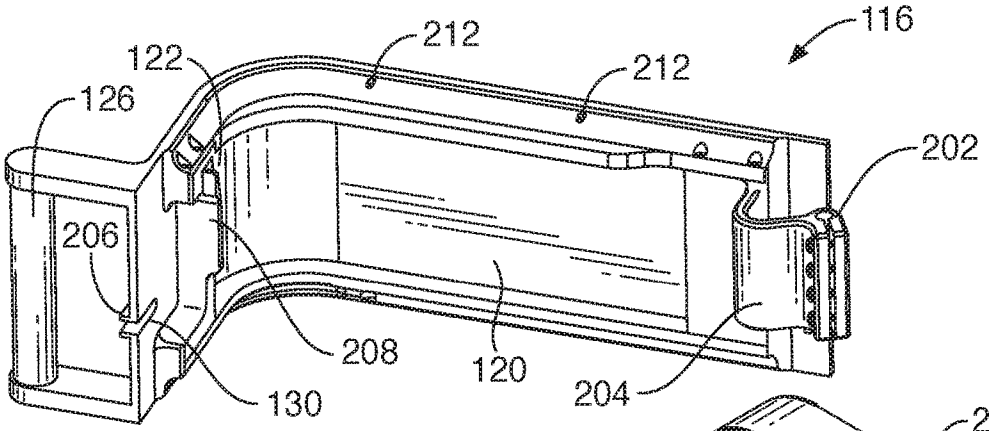
FIG. 5 is an isometric view of a lid for a press in accordance with an embodiment of the present invention.

For example, referring to FIG. 4 while also referring to FIG. 5, in the illustrated embodiment, a hinge pin 200 protrudes from the wall 106 in the horizontal direction 102*b*, i.e. a cylinder with its axis of symmetry substantially parallel to the horizontal direction 102*b*. The lid 106 may define a corresponding hole 202 sized to slide over the hinge pin 200 while still permitting rotation about the hinge pin 200. In the illustrated embodiment the hole 202 is defined in a curved flange 204 that extends downwardly from the top portion 120 of the lid 116. In particular, the curved flange 204 enables the lid 106 to connect to the hinge pint 200 that is located rearwardly of the front edge of the curved portion 118 of the rear wall. As shown in FIG. 4, the curved flange 204 includes a straight portion that extends downwardly (substantially perpendicular to vertical direction 102*a* when the lid 116 is closed) from the top portion with a distal end of the straight portion transitioning to a curved portion that curves backwardly and upwardly thereby enabling the front edge of the curved portion 118.

FIGS. 4 and 5 further illustrate other features that may be included in the lid 116. For example, the slot 130 may include a rim 206 that extends around the slot 130 and protrudes outwardly therefrom, such as from 3 to 5 mm, to further maintain the orientation of the spout 18 of the juice pack 10 when protruding through the slot 130.

In some embodiments, the front portion 122 includes a rib 208 that protrudes inwardly from the front portion 122 and is oriented substantially parallel to the horizontal direction 102*b*. The movable platen 138 may further include a notch 210. In operation, as the movable platen 138 is drawn toward the wall 106, the notch 210 slides over the rib 208 thereby preventing opening of the lid 116. In an alternative embodiment, the rib 208 is formed on the movable platen 138 and a corresponding notch 210 is formed on the lid 116 and engages the rib 208 to prevent opening of the lid 116.

In the illustrated embodiment, the lid 116 further includes pins 212 or other structures extending downwardly at the right edge of the top portion 120. These may engage corresponding structures on the sidewall 112. For example, brackets 214 may be secured to the sidewall 112 and define openings into which the pins 212 insert when the sidewall 112 is engaged and the lid 116 is closed thereby hindering removal of the sidewall 112 when the lid 116 is closed.

As shown in FIG. 4 and FIG. 5, the sidewall 116 defines a recessed region 216 that extends around its inner top edge and inner front edge (and a curved transition between them). The lid 116 (top portion 120 and front portion 122) may seat within this recessed region 216. The brackets 214 may be secured within further recessed regions extending below the recessed region 216. The wall 106 may further define a recessed region 218 around its top and front edges (and a curved transition between them) on the pressing side 108 and into which the lid 116 (top portion 120 and front portion 122) seats when closed. The recessed region 218 may define a further recessed region 220 extending below the recessed region 218. The hook 128 may be located on this recessed region 220 such that the hook 128 does not interfere with closing of the lid 116.

The sidewall 112 may further define a recess 222 extending across a major portion of the extent of the sidewall in the vertical and longitudinal directions 102*a*, 102*c*. The recess 222 may have a depth in the horizontal direction 102*b* when the sidewall 112 is installed on the base 104 that is equal to or greater than a thickness of the movable platen 138 in the horizontal direction 102*b*. When hydraulic pressure is not applied to the piston 160, the springs 188 may urge the movable platen 138 into this recess 222. The amount of travel of the movable platen 138 may be limited by the length of the shafts 140 and may be configured such that the movable platen 138 is not pressed against the sidewall 112, which would tend to dislodge it.

A rear edge 224, such as an inner rear edge 224, of the sidewall 112 may have arms 226 protruding therefrom and having pins 228 secured thereto and extending downwardly therefrom in the vertical direction 102*a*, such as cylindrical pins 228 with the axes of symmetry thereof oriented substantially parallel to the vertical direction 102*a* when the sidewall 112 is secured to the press 100.

The rear wall 114 may define corresponding protrusions 232 defining holes 232 sized to receive the pins 228 while still permitting rotation of the pins 228 within the holes 232. In the illustrated embodiment, the rear wall 114 defines a vertical recessed region 234 extending inwardly from its left edge. The protrusions 232 may protrude into this recessed region 234.

A lower edge 236 of the side wall 116 may be sized to seat against the raised surface 196 and may further include a magnet or ferromagnetic material for retaining the lower edge 236 in engagement with the raised surface 196 by means of interaction with the magnet 198.

In some embodiments, a tray 238 is secured to the front wall 110 and the tray 238 and front wall 110 are likewise removable. In particular, the tray 238 extends rearwardly from the front wall 110 in the longitudinal direction 102*c*. The tray 238 defines a basin or receptacle 240 positioned at the bottom of the pressing chamber and that can collect material that is released from a juice pack 10 in the event of a rupture.

The base 104 may define a receptacle for receiving the tray 138, such as by means of surfaces 242 that protrude vertically from the base 104 and extend in the longitudinal direction 102*c*. The tray 138 may therefore insert between these surfaces 242. The base 104 may define a further receptacle or basin 244 between the surfaces 242 that may collect material that is not collected by the basin 240 of the tray 138, such as due to overflow or splashing. In some embodiments, a portion of the front wall 110 extends below the tray 138. The base 104 may define a notch 248 sized to receive this portion. The front wall 110 may also seat within the recesses 216, 218 in the sidewall 116 and wall 106, respectively, when installed on the press 100.

In some embodiments, the front wall 110 defines a recessed portion 250 for receiving the cup holder 134. For example, the cup holder may include a narrowed portion 252 sized to insert within the recessed portion 250. The inner wall 254 of the recessed portion 250 may be oriented substantially parallel to the vertical and horizontal directions 102*a*, 102*b* and may have one or more hangers 256 secured thereto. Where there are multiple hangers 256, they may be distributed along the vertical direction 102*a* and provide multiple securement points for the cup holder 134 in order to accommodate cups of different sizes. In the illustrated embodiment, the hangers 256 are planar members secured to the inner wall 254 at an offset therefrom such as at least top, and possibly top and side, edges thereof are offset from the inner wall 254. The cup holder 134 may define a slot that receives the top and possibly side edges of the hangers 256 in order to suspend the cup holder 134. The cup holder 134 may be removed completely in order to provide clearance for a pitcher that can rest on the same support surface as the press 100.

In some embodiments, the front wall 110 may define a flared region 258 at the opening of the slot 1323 such that the slot 132 narrows with distance from the top of the front wall. The flared region 258 may facilitate insertion of the spout 18 into the slot 132. In some embodiments, flanges 260 may secure to the front wall 110 on either side of the slot 132 and protrude outwardly therefrom. Inward facing surfaces of the flanges 260 may be flush with sides of the slot 132. The flanges 260 may facilitate alignment of the spout 118 of the juice pack 10 during use. The flanges 260 may be positioned below the flared region 258.

Removal of the front wall 110 and tray 238 during use may be hindered by the lid 116. For example, the front portion 122 of the lid 116 may overlap the front wall 110 as mentioned above. Accordingly, sliding out of the front wall 110 and tray 238 is prevented while the lid 116 is closed.

In order to ensure that the removable portions of the housing are in place during use, magnets maybe embedded in the components and the presence of these magnets may be sensed. For example, magnets 262*a* may be embedded at a rear side of the tray 238 and be detected by corresponding sensors 264*a* on the rear wall 114 or base 104 and positioned to sense the magnets 262*a* when the tray 238 is fully inserted, i.e. pushed within 5 mm of its closest possible position to the rear wall 114.

Magnets 262*b* may be mounted to a lower edge of the sidewall 112 and be sensed by sensors 264*b* on the base 104 when the cover is in place with its lower edge within 5 mm of its closest possible position to the base 104.

Magnets 262*c* may be mounted on the front portion 122 of the lid 116 and be sensed by sensors 264*c* mounted on the wall 264. In particular, a portion 266 of the wall 106 may protrude inwardly into the pressing chamber from the pressing side 106*a* to provide space within the wall 106 to define the chamber 156. The sensors 264*c* may be embedded in or mounted on this portion 266. The sensors 264*c* sense the magnets 262*c* when the lid 116 is closed, such as when the magnets 262*c* are within 5 mm of their closest possible proximity to the sensors 264*c* according to geometry of the lid 116 and portion 266.

The sensors 264*a*-264*c* may be embodied as Hall effect sensors, inductive coil sensors, or other sensors capable of detected presence of a magnetic field. Note that in the illustrated embodiment pairs of magnets 262*a*-262*c* and pairs of sensors 264*a*-264*c* are used at each location for redundancy and added safety. In other embodiments, a single magnet 262*a*-262*c* and single sensor 264*a*-264*c* is used at each location.

Figure 7:
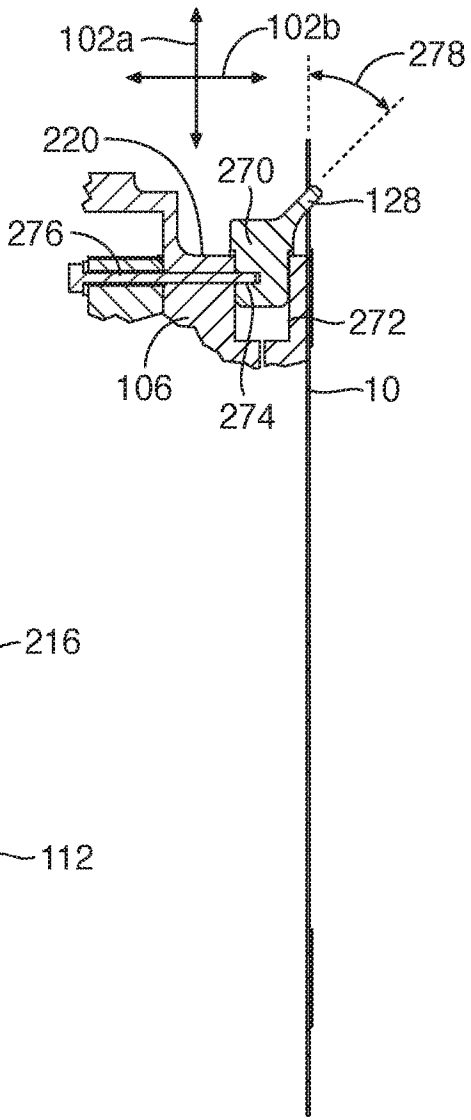
FIG. 7 is a side cross sectional view of a juice pack and hook in accordance with an embodiment of the present invention.
Figure 6:
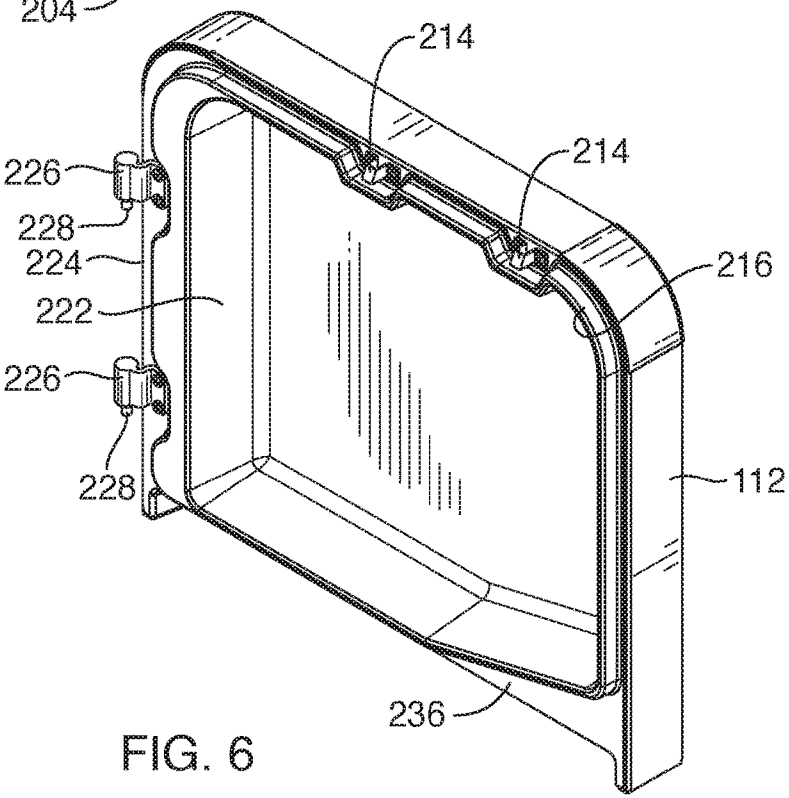
FIG. 6 is an isometric view of a sidewall for a press in accordance with an embodiment of the present invention.

FIG. 7 illustrates an example embodiment of the hook 128. For example, the hook 128 may be a protrusion that extends from a plug 270 that inserts within an opening 272 defined in the wall 106. As is apparent in FIG. 7, the plug 270 includes a narrowed region that inserts within the opening 272 and a widened top portion that is wider than the opening 272 and sits on surface 220. The plug 270 may define an opening 274 that receives a fastener 276 that passes through a portion of the wall 106 and engages the opening 274 within the opening 272 in order to secure the plug 270 within the opening 272.

As is apparent in FIG. 7, the hook 128 is a protuberance defining an angle 278 with respect to the vertical direction 102*a*. This angle 278 may be between 30 and 60 degrees, preferably between 40 and 55 degrees. In some embodiments, the hook 128 and plug 270 have a constant cross section along the longitudinal direction 102*c* except for the opening 274 due to co-molding by an extrusion process.

Figure 8:
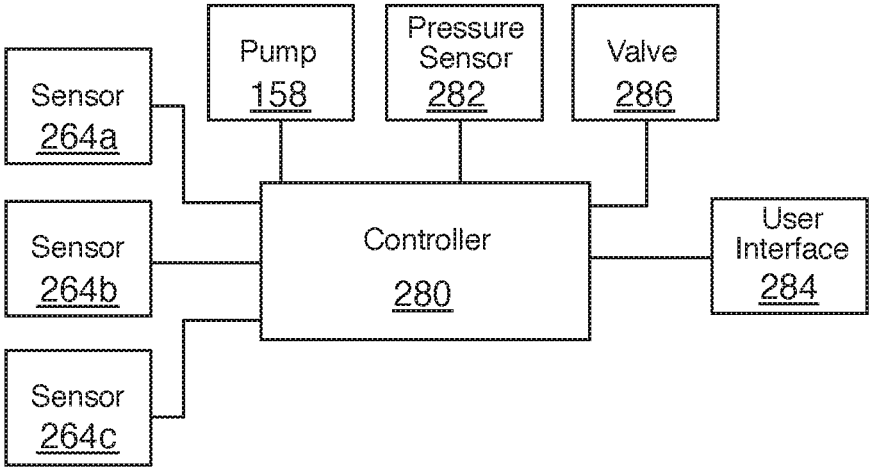
FIG. 8 is a process flow diagram of electronic components of a press in accordance with an embodiment of the present invention.

Referring to FIG. 8, operation of the press 108 may be controlled by a controller 280 that may be embodied as a general purpose computer, circuit board including an application specific integrated circuit (ASIC), field programmable gate array (FPGA), or other electronic device that is programmed or configured to perform the actions ascribed to the controller 280 as described below.

The controller 280 may receive outputs of the sensors 264*a*-264*c* and may further control power have supplied to the hydraulic pump 158. The controller 280 may also be coupled to a pressure sensor 282 that senses pressure at the output of the hydraulic pump 158 or within the chamber 156. The controller 280 may further be coupled to a user interface 284 that may be as simple as one or more buttons and may also include a screen for displaying information or a touch screen for both displaying information and receiving user inputs.

The controller 280 may be programmed to receive the outputs of the sensors 264*a*-264*c* and suspend operation of the pump 158 in response to detecting that any of the sensors 264*a*-264*c* is not sensing a magnet within a threshold proximity. This may occur prior to initiating pressing or at any time after pressing has commenced. Where a magnet ceases to be detected by one of the sensors 264*a*-264*c* the controller 280 may further invoke closing a valve that prevents exit of hydraulic fluid from the chamber 156 and cylinder 150 in order to prevent the springs 188 from translating the movable platen 138 and potentially causing injury.

If all of the sensors 264*a*-264*c* sense a magnet within threshold proximity and an input is received from the user interface 284 to initiate pressing, the controller 280 invokes the pump 158 to increase pressure of hydraulic fluid within the camber 156 and cylinder 150, thereby forcing the piston 160 to the left and causing the movable platen 138 to move toward the wall 106. In some embodiments, no displacement sensor is used. Accordingly, the controller 280 controls the pump 158 in accordance with the sensed pressure according to the output the pressure sensor 282. For example, the controller 280 may cause the pump to increase the sensed pressure to a predefined pressure possibly at a predefined rate of increase, hold the predefined pressure for a predefined hold time, and then release the pressure at a predefined rate or without regard to rate. In some embodiments, release of pressure may be accomplished by deactivating the pump 158 and controlling opening of the valve 286 in order to achieve a desired rate of reduction in the pressure.

Note that there may be multiple pressing profiles that each define a predefined pressure and hold times. The multiple pressing profiles may define a rate of increase in pressure to the predefined pressure and may define a rat of decrease in pressure upon expiration of the hold time. These different pressing profiles may correspond to different types of food items that are within the juice pack 10 being pressed. For example, fresh produce may have a different pressing profile than frozen produce. Nuts may be pressed using the press 100 to make nut butters and may have a corresponding pressing profile. A pressing profile may be defined for a particular number or range of numbers of juice packs positioned within the pressing chamber.

The user interface 284 may define different buttons for invoking a particular pressing profile. Alternatively, a touch screen interface or a screen in combination with input buttons may be used to guide a user to select a desired pressing profile.

Figure 9:
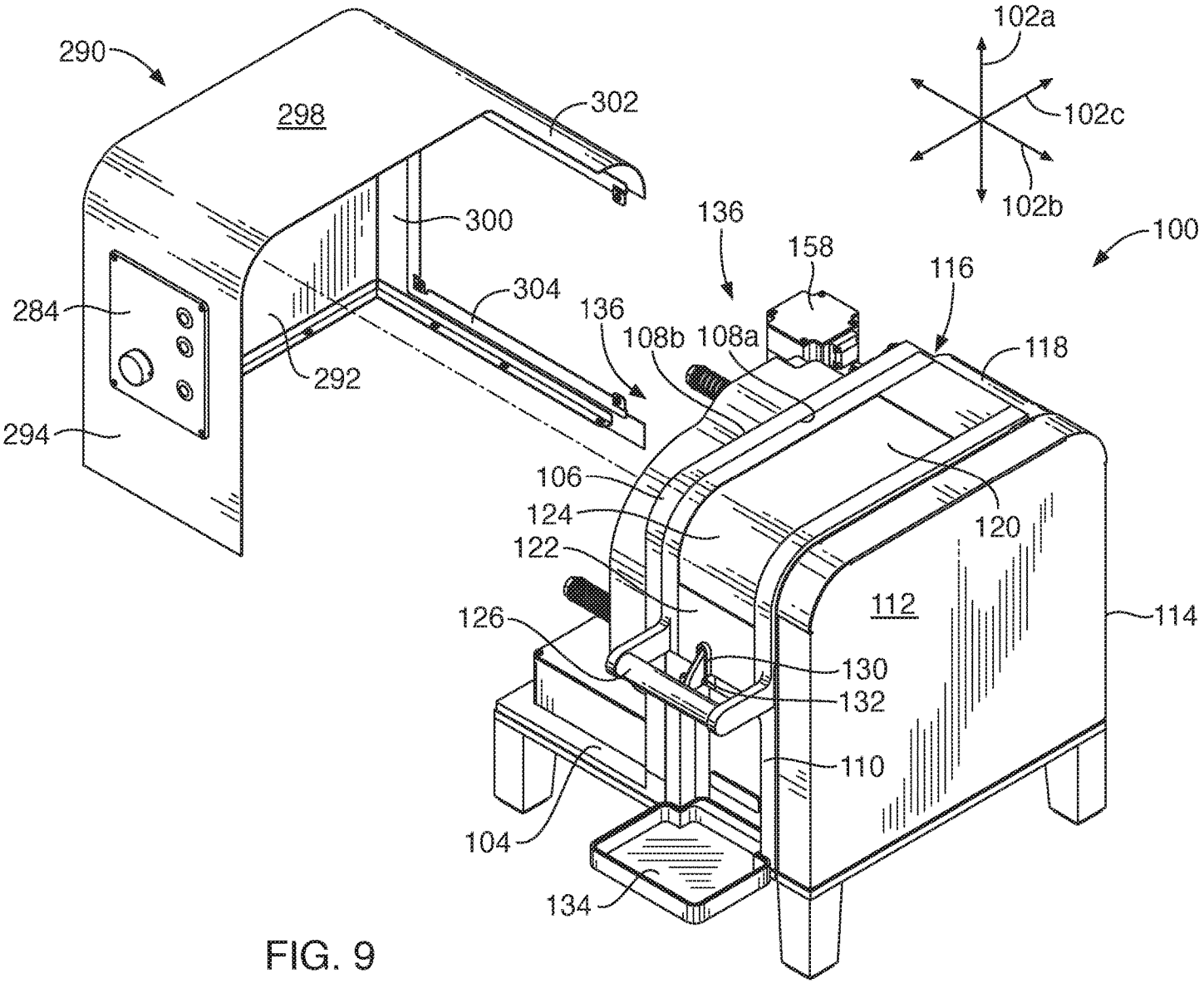
FIG. 9 is a isometric view of a press including a drive-side cover incorporating a user interface in accordance with an embodiment of the present invention.

Referring to FIG. 9, in some embodiments, the user interface 284 is incorporated into a drive side housing 290 positioned on the drive side 108*b* of the wall 106*b*. For example, the housing 290 may include a sidewall 292 substantially parallel to the vertical and longitudinal directions 102*a*, 102*c*; a front wall substantially parallel to the vertical and horizontal directions 102*a*, 102*b*; a top wall 298 substantially parallel to the horizontal and longitudinal directions 102*b*, 102*c*; and a rear wall 300 substantially parallel to the vertical and horizontal directions 102*a*, 102*b*.

As is apparent in FIG. 9, there may be a curved transition between the front wall 294 and the top wall 298 that may match (e.g., within 3 to 5 mm) the radius of curvature of the curved transition region 124 and other curved transition between top and front sides of the wall 106 and sidewall 114.

In the illustrated embodiment, the curved transition between the top wall 298 and the rear wall 300 extends inwardly from the top wall 298 and extends over or under the curved portion 118 of the rear wall 118. Another extension 304 of the rear wall 300 may extend along the base 104 on the pressing side 108*a* of the wall 106.

The side wall 292 and rear wall 300, such as the extension 304, may fasten to the base 104. For example, the base may define a groove or recess along its front, left side, and rear side into which the front wall 294, side wall 292, and rear wall 300 seat and to which these are fastened by means of screws or other fasteners. In some embodiments, the extension 302 and extension 304 also secure to the rear wall 114 and/or wall 106 by means of screws or other fasteners.

Note that in the illustrated embodiment, the rear wall 300 is only partial and a portion of the drive side of the press 100 is exposed at the back when the drive side housing 290 is in place. This opening may be present to provide air flow over the pump 158 or other components of the drive 136. The opening may be left open or may be covered with a screen, louvered plate, or other covering that permits airflow.

Figures 10A, 10B, 10C:
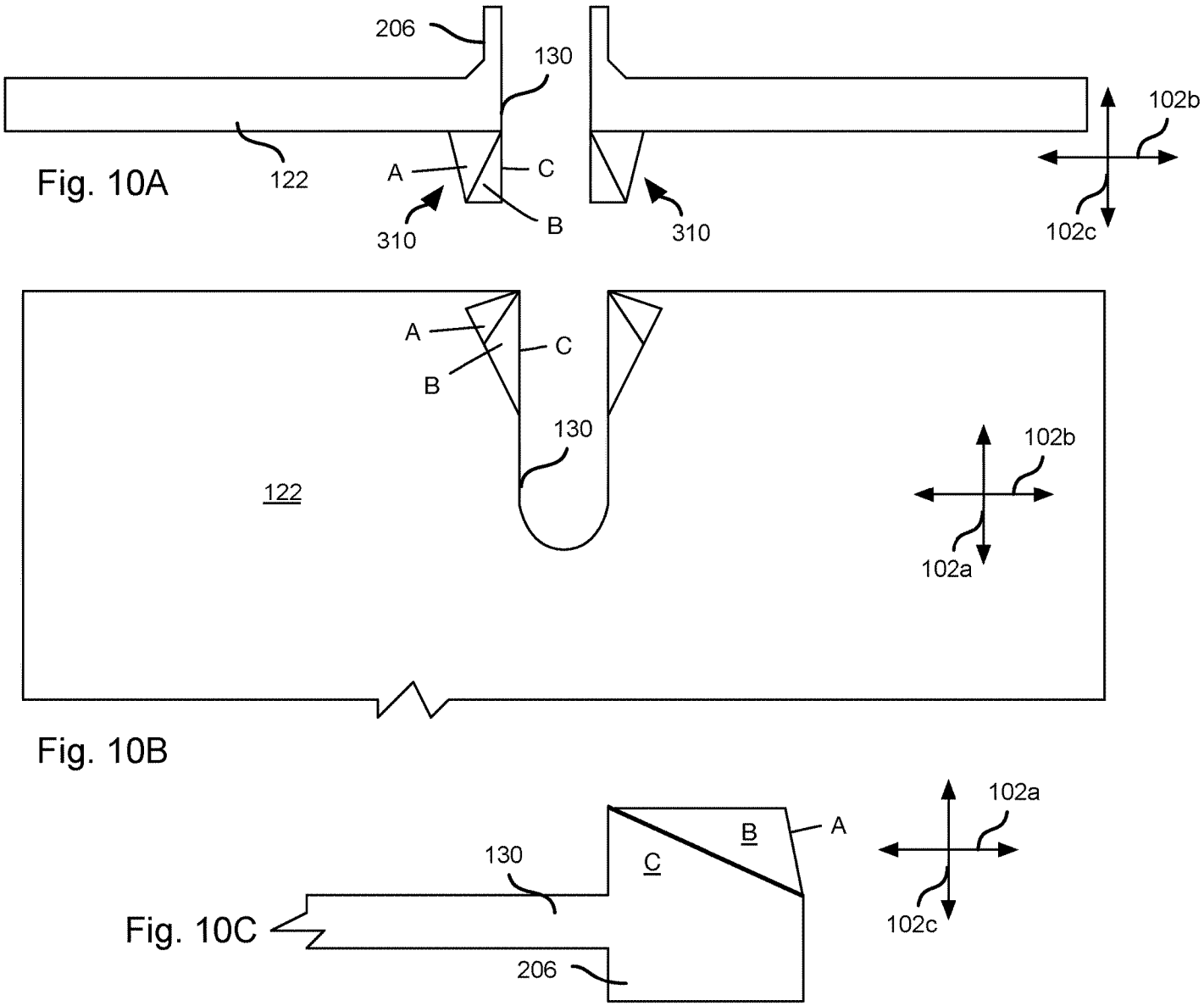
FIGS. 10A to 10C illustrate inner spout guides for a lid of a press in accordance with an embodiment of the present invention.

Referring to FIGS. 10A to 10C, in some embodiments, the front portion 122 may include inwardly projecting spout guides 310 on either side of the slot 130 and that may be mirror images of one another about a vertical-longitudinal plane parallel to the vertical direction 102*a* and the longitudinal direction 102*c*. In particular, as shown in FIG. 10B the projections 310 may be positioned one either side of the slot 130 at the bottom edge of the front portion 122. The spout guides 310 may facilitate guiding of the spout 18 of a juice pack 10 into the slot 130 of the front portion 122 and into the slot 132 of the front wall 110.

In particular note that as the lid is lowered over the juice pack 10, the front portion 122 is not oriented perpendicularly, i.e. parallel to the horizontal direction 102*b* and vertical direction 102*a*. Accordingly, the spout guides 310 may be provided with various facets A, B, C that provide a flared opening that guides the spout 18 into the slot 130 notwithstanding some misalignment of the spout 18.

As is apparent in FIGS. 10A to 10C there are two facets A and B that are angled (neither perpendicular nor parallel) to any of the directions 102*a*, 102*b*, 102*c*. For example, facet B provides a flare that widens with movement toward the lower edge of the front portion 122 in both a vertical-horizontal plane parallel to the vertical and horizontal directions 102*a*, 102*b* and a horizontal-longitudinal plane parallel to the horizontal and longitudinal directions 102*b*, 102*c*.

As is apparent in FIG. 10C, facet B shares one edge with facet C, which may be flush with or a continuation of a side of the slot 130. Facet B further shares an edge with facet A that is located between facet B and the lower edge of the front portion 122. As is apparent, facet A is likewise angled with respect to all of the directions 102*a*-102*c*. As is also apparent, facets A and B are triangles. A may have its base parallel to the inner surface of the front portion 122 on which it is formed.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

The invention claimed is:

1. A press comprising:

a housing defining a pressing chamber with an opening on a top side of the pressing chamber for receiving a juice pack;

a non-moving platen defining a first pressing face;

a movable platen defining a second pressing face;

a drive engaging the movable platen and configured to move the movable platen toward the non-moving platen;

an outlet in a front wall of the housing and positioned vertically between a top of the movable platen and a bottom of the movable platen;

a lid pivotably secured to the housing and selectively placeable over the opening; and a pin extending horizontally from the non-moving platen, the id being pivotably mounted to the pin.

2. The press of claim 1, wherein the outlet is vertically located within a region that is within 20 percent a vertical height of the movable platen from a vertical center of the movable platen.

3. The press of claim 1, further comprising a hook mounted to the non-moving platen and configured to suspend the juice pack between the movable platen and the non-moving platen.

4. A press comprising:

a housing defining a pressing chamber with an opening on a top side of the pressing chamber for receiving a juice pack;

a non-moving platen defining a first pressing face;

a moveable platen defining a second pressing face;

a drive engaging the movable platen and configured to move the movable platen toward the non-moving platen;

an outlet in a front wall of the housing and positioned vertically between a top of the movable platen and a bottom of the movable platen;

a lid pivotably secured to the housing and selectively placeable over the opening;

wherein the lid includes a front portion extending downwardly along a front of the housing; and wherein the outlet comprises a first slot defined in the front wall and a second slot defined in the lid and aligned with the first slot when the lid is closed over the opening.

5. The press of claim 4, wherein the front portion of the lid defines a rib and the movable platen defines a notch positioned to pass over the rib when the movable platen is moved toward the non-moving platen such that engagement of the rib with the notch prevents opening of the lid.

6. The press of claim 4, further comprising:

a base, the non-moving platen and drive being mounted to the base;

a tray secured to the front wall and extending rearwardly from the front wall and defining a basin, the tray being slidable into engagement with the base having the basin positioned below the movable platen within the pressing chamber.

7. The press of claim 6, wherein a portion of the front portion of the lid vertically overlaps the front wall such that the front portion of the lid resists removal of the front wall and tray when the lid is closed over the opening.

8. The press of claim 7, wherein the housing further comprises a sidewall defining a recess sized to receive the movable platen, the sidewall being removable.

9. The press of claim 8, wherein the housing defines a rear wall opposite the front wall, the sidewall being pivotably engaged with the rear wall.

10. The press of claim 9, further comprising:

magnets embedded in each of the lid, tray, and sidewall;

sensors embedded in the base and movable platen configured to sense presence of the magnets; and a controller coupled to the sensors and programmed to suspend operation of the drive in response to an output of at least one of the sensors indicating that one of the magnets is not present.

11. A press comprising:

a housing defining a pressing chamber with an opening on a top side of the pressing chamber for receiving a juice pack;

a non-moving platen defining a first pressing face;

a moveable platen defining a second pressing face;

a drive engaging the movable platen and configured to move the movable platen toward the non-moving platen; and an outlet in a front wall of the housing and positioned vertically between a top of the movable platen and a bottom of the movable platen;

wherein the drive comprises:

a chamber defined in the movable platen on a drive side of the movable platen, the movable platen being positioned on a pressing side of the movable platen opposite the drive side;

a cylinder secured to the drive side of the movable platen around the chamber;

a piston positioned within the cylinder;

a distributor plate positioned having the piston between the distributor plate and the drive side of the movable platen; and drive rods that are each secured to the distributor plate, extend through the non-moving platen, and secured to the movable platen.

12. The press of claim 11, further comprising:

return rods that pass each include a head and a shaft that passes through the distributor plate and is fastened to the drive side of the non-moving platen; and springs encircling each of the return rods between the head thereof and the distributor plate.

13. The press of claim 12, further comprising a diaphragm captured between the cylinder and the drive side of the non-moving platen, the diaphragm passing between the piston and the chamber.

14. The press of claim 13, wherein the diaphragm has a hat shape having a brim portion captured between the cylinder and the drive side of the non-moving platen and a crown positioned between the piston and the chamber.

15. A method comprising:

providing a press including:

a housing defining a pressing chamber with an opening on a top side of the pressing chamber for receiving a juice pack;

a non-moving platen defining a first pressing face;

a movable platen defining a second pressing face;

a drive engaging the movable platen and configured to move the movable platen toward the non-moving platen;

an outlet in a front wall of the housing and positioned vertically between a top of the movable platen and a bottom of the movable platen, the outlet being vertically located within a region that is within 20 percent a vertical height of the movable platen from a vertical center of the movable platen;

inserting a juice pack within the pressing chamber having a spout of the juice pack protruding out of the pressing chamber through the outlet;

drawing, by the drive, the movable platen toward the non-moving platen effective to compress the juice pack and force juice out of the juice pack through the spout;

providing a hook mounted to the non-moving platen; and suspending the juice pack on the hook;

wherein the juice pack has edges defining a rectangular shape, the spout protruding from a first corner of the rectangular shape and an aperture defined at a second corner of the rectangular shape, the first corner and the second corner being intersected by a same edge of the edges of the rectangular shape;

wherein suspending the juice pack on the hook comprises placing the aperture over the hook.

16. A method comprising:

providing a press including:

a housing defining a pressing chamber with an opening on a top side of the pressing chamber for receiving a juice pack;

a non-moving platen defining a first pressing face;

a moveable platen defining a second pressing face;

a drive engaging the moveable platen and configured to move the movable platen toward the non-moving platen;

an outlet in a front wall of the housing and positioned vertically between a top of the movable platen and a bottom of the movable platen, the outlet being vertically located within a region that is within 20 percent a vertical height of the movable platen from a vertical center of the movable platen;

inserting a juice pack within the pressing chamber having a spout of the juice pack protruding out of the pressing chamber through the outlet;

drawing, by the drive, the movable platen toward the non-moving platen effective to compress the juice pack and force juice out of the juice pack through the spout, providing a lid pivotably secured to the housing and selectively placeable over the opening, the lid includes a front portion extending downwardly along a front of the housing, the front portion defining a first slot and the front wall defining a second slot;

inserting the spout protrudes out of the pressing chamber through the second slot; and closing the lid such that the spout also protrudes out of the pressing chamber through the first slot.

* * * * *